US007384011B1

(12) United States Patent
Smith

(10) Patent No.: US 7,384,011 B1
(45) **Date of Patent: *Jun. 10, 2008**

(54) MULTI-FUNCTIONAL TOOL ASSEMBLY FOR PROCESSING TOOL OF WASTE PROCESSING MACHINE

(76) Inventor: Leward Nile Smith, Route 11, Box 3650, Lake City, FL (US) 32024-9358

( * ) Notice: Subject to any disclaimer, the term of this patent is extended or adjusted under 35 U.S.C. 154(b) by 129 days.

This patent is subject to a terminal disclaimer.

(21) Appl. No.: 11/416,806

(22) Filed: May 3, 2006

Related U.S. Application Data

(63) Continuation-in-part of application No. 11/042,590, filed on Jan. 25, 2005, now Pat. No. 7,121,485, which is a continuation of application No. 09/970,060, filed on Oct. 3, 2001, now Pat. No. 6,845,931.

(51) Int. Cl.
*B02C 13/288* (2006.01)

(52) U.S. Cl. ..... 241/55; 241/294

(58) Field of Classification Search ..... 241/55, 241/188.1, 189.1, 191, 197, 294
See application file for complete search history.

(56) References Cited

U.S. PATENT DOCUMENTS

| | | | |
|---|---|---|---|
| 190,675 | A | 5/1877 | Gaines |
| 589,236 | A | 8/1897 | Williams |
| 604,283 | A | 5/1898 | Albrecht |
| 787,290 | A | 4/1905 | Griffin |
| 1,266,894 | A | 5/1918 | Willimas |
| 1,559,924 | A | 11/1925 | Willcox |
| 1,713,507 | A | 5/1929 | Ammon |
| 1,752,290 | A | 4/1930 | Ammon |
| 1,761,083 | A | 6/1930 | Liggett |
| 1,860,519 | A | 5/1932 | Wickersham |
| 1,889,129 | A | 11/1932 | Nielsen |
| 1,902,721 | A | 3/1933 | Reynolds |
| 2,026,790 | A | 1/1936 | Mankoff |
| 2,128,194 | A | 8/1938 | Sheldon et al. |
| 2,244,577 | A | 6/1941 | Schreiber |
| 2,318,219 | A | 5/1943 | Harris |
| 2,392,958 | A | 1/1946 | Tice |
| 2,663,505 | A | 12/1953 | Sennholtz |

(Continued)

FOREIGN PATENT DOCUMENTS

| | | |
|---|---|---|
| JP | 60-140645 | 9/1985 |

(Continued)

OTHER PUBLICATIONS

Wood Waste Disposal Problems: Bandit Has Some Answers!, Bandit Industries, Inc. Hard Hat News, Oct. 22, 1993. Bandit Industries, Inc., Reader Card 218, Forest Publications, Timber West, Nov. 1993.

(Continued)

*Primary Examiner*—Mark Rosenbaum
(74) *Attorney, Agent, or Firm*—Bliss McGlynn, P.C.

(57) ABSTRACT

A multi-functional tool assembly for a waste processing machine includes waste reducer to reduce waste material. The multi-functional tool assembly also includes a single tool to support the waste reducer. The tool includes a head, a fan, and a shaft integrally formed therein. The fan is disposed radially below the waste reducer to aggressively output reduced waste material from the waste processing machine.

18 Claims, 3 Drawing Sheets

U.S. PATENT DOCUMENTS

| | | | |
|---|---|---|---|
| 2,705,596 | A | 4/1955 | Pyser |
| 2,710,635 | A | 6/1955 | Alexander |
| 2,863,476 | A | 12/1958 | Clark |
| 2,864,420 | A | 12/1958 | Schmidt |
| 2,900,069 | A | 8/1959 | Manns et al. |
| 3,035,682 | A | 5/1962 | Ferch |
| 3,194,543 | A | 7/1965 | McIlvaine |
| 3,203,532 | A | 8/1965 | Mimnaugh et al. |
| 3,254,687 | A | 6/1966 | Tertyshnikov |
| 3,367,585 | A | 2/1968 | Ratkowski |
| 3,436,028 | A | 4/1969 | Koehnen et al. |
| 3,509,924 | A | 5/1970 | Newhouse, Jr. |
| 3,642,214 | A | 2/1972 | Blackwell, Jr. |
| 3,844,494 | A | 10/1974 | Hightower |
| 3,907,016 | A | 9/1975 | Nicholson et al. |
| 4,000,859 | A | 1/1977 | Whitney |
| 4,060,961 | A | 12/1977 | Anderson et al. |
| 4,074,594 | A | 2/1978 | Dall et al. |
| 4,076,177 | A | 2/1978 | Hirayama et al. |
| 4,077,450 | A | 3/1978 | Ackerman |
| 4,077,573 | A | 3/1978 | Kersey et al. |
| 4,117,985 | A | 10/1978 | Lazareck |
| 4,129,260 | A | 12/1978 | Baker |
| 4,129,262 | A | 12/1978 | Lowry |
| 4,146,184 | A | 3/1979 | Whitney |
| 4,146,185 | A | 3/1979 | Schober |
| 4,162,769 | A | 7/1979 | Lapointe |
| 4,162,770 | A | 7/1979 | Lewis |
| 4,168,035 | A | 9/1979 | Palm et al. |
| 4,344,581 | A | 8/1982 | Redemann |
| 4,504,019 | A | 3/1985 | Newell et al. |
| 4,558,826 | A | 12/1985 | Martinek |
| 4,573,643 | A | 3/1986 | Orphall et al. |
| 4,688,731 | A | 8/1987 | Hunt et al. |
| 4,702,424 | A | 10/1987 | Widlak |
| 4,717,083 | A | 1/1988 | Quast et al. |
| 4,848,681 | A | 7/1989 | Eriksson et al. |
| 4,850,406 | A | 7/1989 | Krautzberger |
| 4,872,500 | A | 10/1989 | Duffey et al. |
| 4,915,310 | A | 4/1990 | Stelk |
| 4,917,314 | A | 4/1990 | Manschwetus |
| 4,922,977 | A | 5/1990 | Colton et al. |
| 4,967,969 | A | 11/1990 | Griffith, III |
| 4,982,904 | A | 1/1991 | Greiner |
| 5,002,233 | A | 3/1991 | Williams |
| 5,042,727 | A | 8/1991 | Plante |
| 5,044,567 | A | 9/1991 | Hausler et al. |
| 5,078,328 | A | 1/1992 | Willingham |
| 5,114,085 | A | 5/1992 | Inui |
| 5,205,496 | A | 4/1993 | O'Donnell et al. |
| 5,209,278 | A | 5/1993 | Carpenter et al. |
| 5,285,974 | A | 2/1994 | Cesarini |
| 5,372,316 | A | 12/1994 | Bateman |
| 5,377,919 | A | 1/1995 | Rogers et al. |
| 5,381,971 | A | 1/1995 | Rehmer |
| 5,392,999 | A | 2/1995 | Konig et al. |
| 5,404,993 | A | 4/1995 | Scarro |
| 5,413,286 | A | 5/1995 | Bateman |
| 5,435,689 | A | 7/1995 | Stonehouse |
| 5,474,239 | A | 12/1995 | Williams, Jr. et al. |
| 5,507,441 | A | 4/1996 | De Boef et al. |
| 5,526,988 | A | 6/1996 | Rine |
| 5,529,249 | A | 6/1996 | Braun et al. |
| 5,605,291 | A | 2/1997 | Doskocil |
| 5,611,496 | A | 3/1997 | Fleenor |
| 5,713,525 | A | 2/1998 | Morey |
| 5,743,314 | A | 4/1998 | Puch |
| 5,863,003 | A | 1/1999 | Smith |
| 5,938,129 | A | 8/1999 | Forsyth |
| 6,016,979 | A | 1/2000 | Squires et al. |
| 6,047,912 | A | 4/2000 | Smith |
| 6,059,210 | A | 5/2000 | Smith |
| 6,299,082 | B1 | 10/2001 | Smith |
| 6,517,020 | B1 | 2/2003 | Smith |
| 6,845,931 | B1 | 1/2005 | Smith |
| 7,007,874 | B1 | 3/2006 | Smith |
| 7,121,485 | B2 * | 10/2006 | Smith ..... 241/55 |

FOREIGN PATENT DOCUMENTS

| | | |
|---|---|---|
| JP | 64-7960 | 1/1989 |
| JP | 1-65650 | 4/1989 |
| JP | 8-299825 | 11/1996 |

OTHER PUBLICATIONS

Bandit's Beast Maintains Nature's Beauty, Construction Equipment Guide, Jun. 1, 1994. The Beast, Model 30 Grinding Yard Waste, Model 15, Grinding Housing Demolition, Waste Handling Equipment News, Sep. 1994.

Bandit Industries' Model 15-H Beast Recycler, Forest Products Equipment, Aug. 1994. The Model 15 Beast, Bandit Industries, Inc., MSW Management, Mar./Apr. 1994.

Want to Lower the Cost of Breaking Down Yard and Other Landfill Waste? . . . Try the Beast from Bandit, Resource Recycling, Nov. 1994. Turn Your Green Waste Into Green Dollars, Bandit Industries, Inc., Sportsturf, 1994.

"Product Release" for the new Model 15-H Beast Recycler Offered by Bandit Industries, Waste Handling Equipment New, Jun. 1994. For Your Chipping and Grinding Needs, Bandit Industries, Inc., Forest Products Equipment, Aug. 1994.

Megagrind by Rexworks 800, 1995. How to chop yard waste costs!, 1000 Commercial Grinder, Framhand. The Beast, Model 15-H, Bandit Industries, Inc.

The Beast Recyclers from Bandit Industries . . . with Big Appetites for Waste, Bandit Industries. The Beast—Coming in the Summer of 1993 from Bandit Industries, Inc., Bandit Industries, Inc.

Maxigrind by Rexworks, The Most Versatile Materials Processing Machine. Industrial Grinder, Big Bite, Manufactured by Haybuster.

* cited by examiner

MULTI-FUNCTIONAL TOOL ASSEMBLY FOR PROCESSING TOOL OF WASTE PROCESSING MACHINE

CROSS-REFERENCE TO RELATED APPLICATION(S)

The present application is a continuation-in-part of U.S. patent application Ser. No. 11/042,590, filed Jan. 25, 2005, now U.S. Pat. No. 7,121,485 which is a continuation of U.S. patent application Ser. No. 09/970,060, filed Oct. 3, 2001, now U.S. Pat. No. 6,845,931.

BACKGROUND OF THE INVENTION

1. Field of the Invention

The present invention relates generally to waste processing machines and, more particularly, to a multi-functional tool assembly for a processing tool of a waste processing machine.

2. Description of the Related Art

It is known to provide waste processing machines to reduce waste material. The waste processing machine typically includes a rotor assembly for reducing the waste material as the rotor assembly rotates. An example of such a rotor assembly for a waste processing machine is disclosed in U.S. Pat. No. 5,863,003, issued Jan. 26, 1999, to Smith, entitled "WASTE PROCESSING MACHINE". In that patent, the rotor assembly includes a rotor having a plurality of spaced pairs of mounting arms. The rotor assembly also includes a processing tool mounted to each pair of mounting arms. An example of such a processing tool is disclosed in U.S. Pat. No. 6,047,912, issued Apr. 11, 2000, to Smith, entitled "BREAK-AWAY PROCESSING TOOL FOR A WASTE PROCESSING MACHINE". In that patent, the processing tool includes a tool holder attached to the mounting arms of the rotor assembly by fasteners. The tool holder has a pair of spaced arms extending radially with a tool for reducing waste product attached to one arm and a wear bar or raker for depth limiting guiding attached to the other arm. Typically, the tool is of a single cutting, bullet, or fan type having a head attached to a shaft by suitable means such as brazing. The shaft of the tool is extended through an aperture in the arm of the processing tool and secured thereto by a fastener such as a nut.

Typically, the tool of the cutting type is used for cutting waste material and provides aggressive intake of waste material, but poor output of reduced waste material. The tool of the bullet type is used for splitting waste material to reduce it without cutting and provides aggressive intake of waste material, but provides poor output of reduced waste material. The tool of the fan type is used for impacting waste material such as grass and leaves to reduce it without cutting and provides poor intake of waste material, but provides aggressive output of reduced waste material.

An example of the above tools are disclosed in U.S. Pat. No. 6,059,210, issued May 9, 2000, to Smith, entitled "ROTOR ASSEMBLY FOR A WASTE PROCESSING MACHINE". In that patent, the rotor assembly includes a rotor and a plurality of processing tools mounted to the rotor. The processing tools include a combination of at least two different types of tools to provide aggressive intake of waste material and aggressive output of reduced waste material in the waste processing machine.

Recently, one application of the waste processing machine is for reducing roofing shingles. Typically, the roofing shingles have an abrasive bonded to a matting. When the roofing shingles are reduced in the rotor assembly, the abrasive circulates past the cutting tool, resulting in abrasion of the processing tool and the rotor assembly. If the abrasion is severe, the entire processing tool or the rotor assembly must be replaced, which is expensive, time consuming, and undesired. Therefore, it is critical to get the abrasive out of the rotor assembly as quickly as possible.

Therefore, it is desirable to provide a single multi-functional tool assembly in a waste processing machine for reducing waste material and aggressively outputting the reduced waste material. It is also desirable to provide a multi-functional tool assembly for reducing roofing shingles and aggressively outputting the abrasive from a rotor assembly of a waste processing machine. It is further desirable to provide a multi-functional tool assembly for a waste processing machine that reduces wear of a tool holder of a processing tool when reducing waste material containing an abrasive. It is still further desirable to provide a multi-functional tool assembly that reduces disproportionate wear and maintains acceptable product life. Therefore, there is a need in the art to provide a multi-functional tool assembly for a processing tool of a waste processing machine that allows a single tool to both reduce waste material and to aggressively output the reduced waste material while maintaining uniform wear and acceptable product life.

SUMMARY OF THE INVENTION

It is, therefore, one object of the present invention to provide a multi-functional tool assembly for a processing tool of a waste processing machine.

To achieve the foregoing objects, the present invention is a multi-functional tool assembly for a waste processing machine. The multi-functional tool assembly includes waste reducer to reduce waste material. The multi-functional tool assembly also includes a single tool to support the waste reducer. The tool includes a head, a fan, and a shaft integrally formed therein. The fan is disposed radially below the waste reducer to aggressively output reduced waste material from the waste processing machine.

One advantage of the present invention is that a multi-functional tool assembly is provided for a processing tool of a waste processing machine. Another advantage of the present invention is that the multi-functional tool assembly is a single multi-functional tool that allows waste material to be reduced and aggressively outputs the reduced waste material from the rotor assembly in the waste processing machine. Yet another advantage of the present invention is that the multi-functional tool assembly is a multi-functional tool that aggressively outputs the reduced waste material to prevent wear of the tool holder of the processing tool. Still another advantage of the present invention is that the multi-functional tool assembly reduces roofing shingles and aggressively outputs the abrasive of the roofing shingles from the rotor assembly of the waste processing machine. Still another advantage of the present invention is that the multi-functional tool assembly prevents disproportionate wear and maintains acceptable product life.

Other objects, features, and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
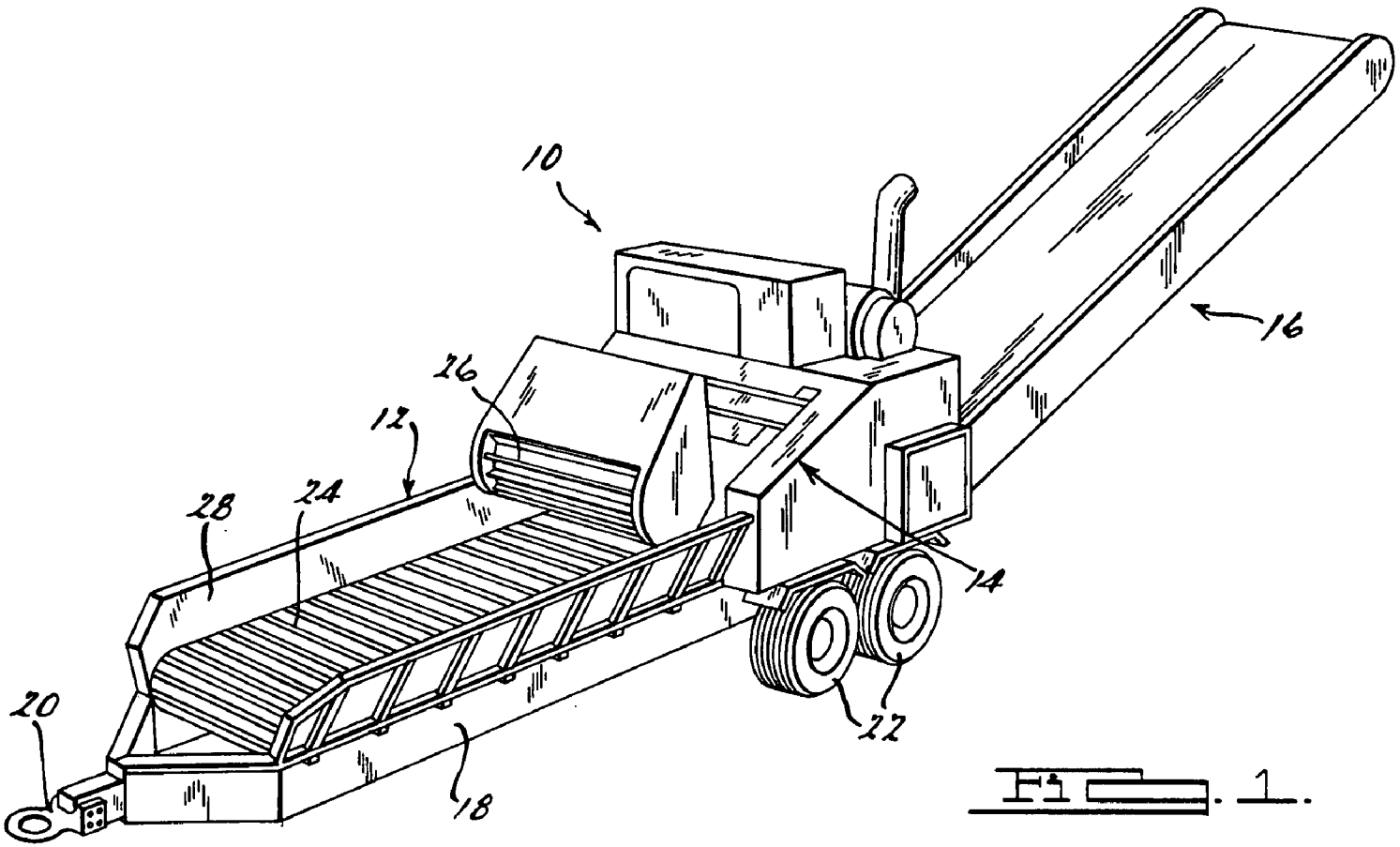
FIG. 1 is a perspective view of a waste processing machine.

Referring now to the drawings and in particular to FIG. 1, one embodiment of a waste processing machine 10 for reducing waste material is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10. The waste processing machine 10 may be supported on a trailer framework 18 having a tongue mount 20 provided at a front thereof and wheels 22 near a rear of the framework 18. It should be appreciated that, with this structure, the infeed system 12 and waste reducing system 14 can be transported together while the discharge system 16 can be transported separately therefrom.

Figure 2:
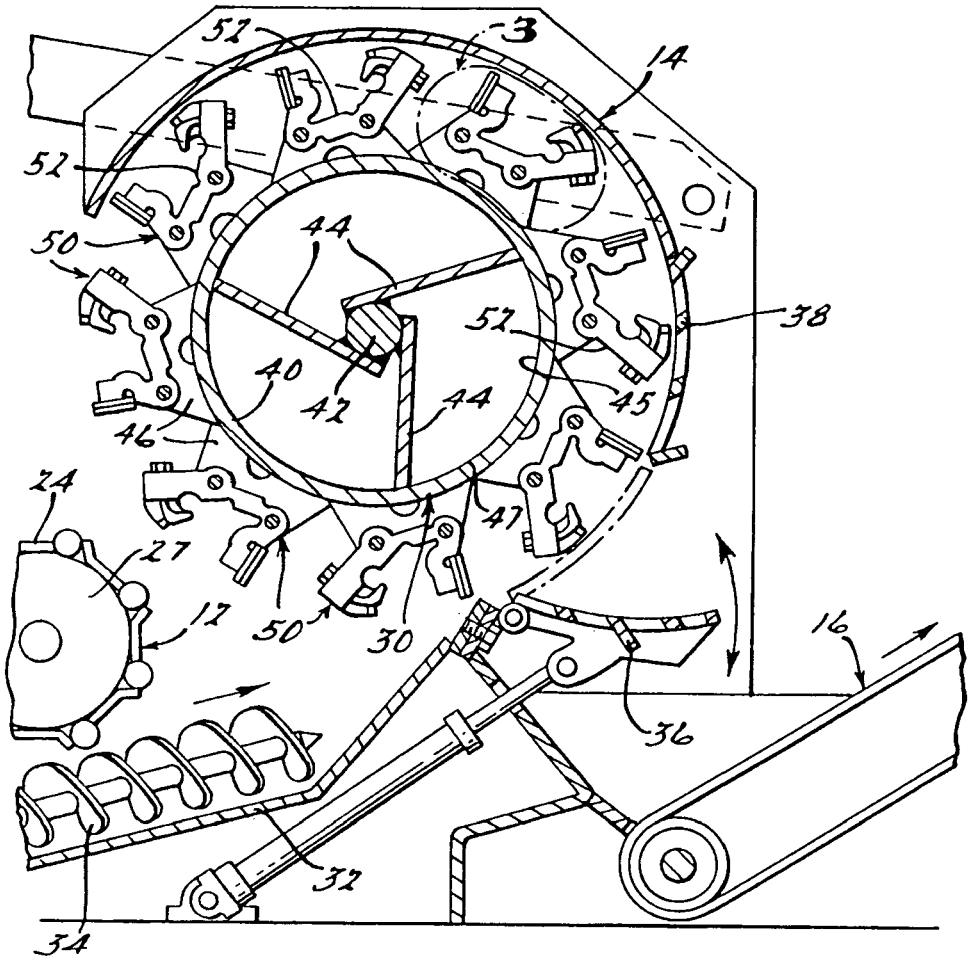
FIG. 2 is a fragmentary elevational view of a rotor assembly of the waste processing machine of FIG. 1.
Figure 5:
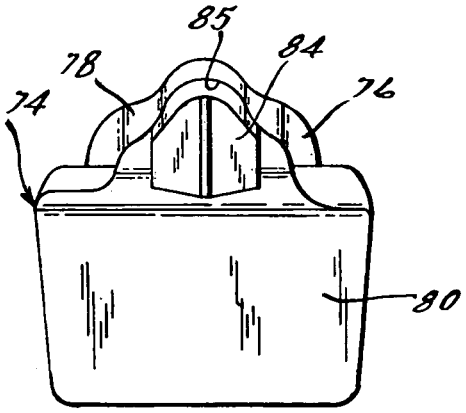
FIG. 5 is a fragmentary elevational front view of a multi-functional tool assembly, according to the present invention, of the processing tool of FIG. 4.
Figure 6:
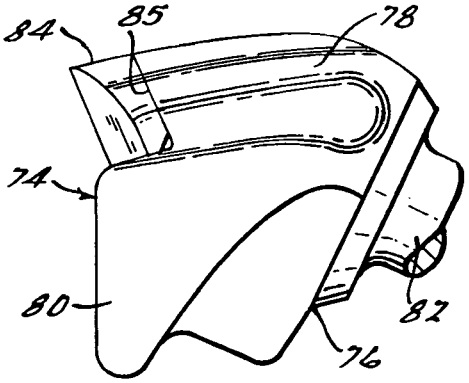
FIG. 6 is a fragmentary elevational side view of a multi-functional tool assembly, according to the present invention, of the processing tool of FIG. 4.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the waste reducing system 14. The infeed conveyor 24 is the sole means of support for the waste material and acts as a primary anvil for reducing the waste material by the rotor assembly 30 to be described. Opposed side walls 28 are provided on opposite sides of the infeed conveyor 24 to contain the waste material. It should be appreciated that waste material is placed on the infeed conveyor 24, which moves the waste material into contact with the feed wheel assembly 26, which, in turn, rotates and feeds the waste material into contact with the rotor assembly 30 of the waste reducing system 14.

Figure 3:
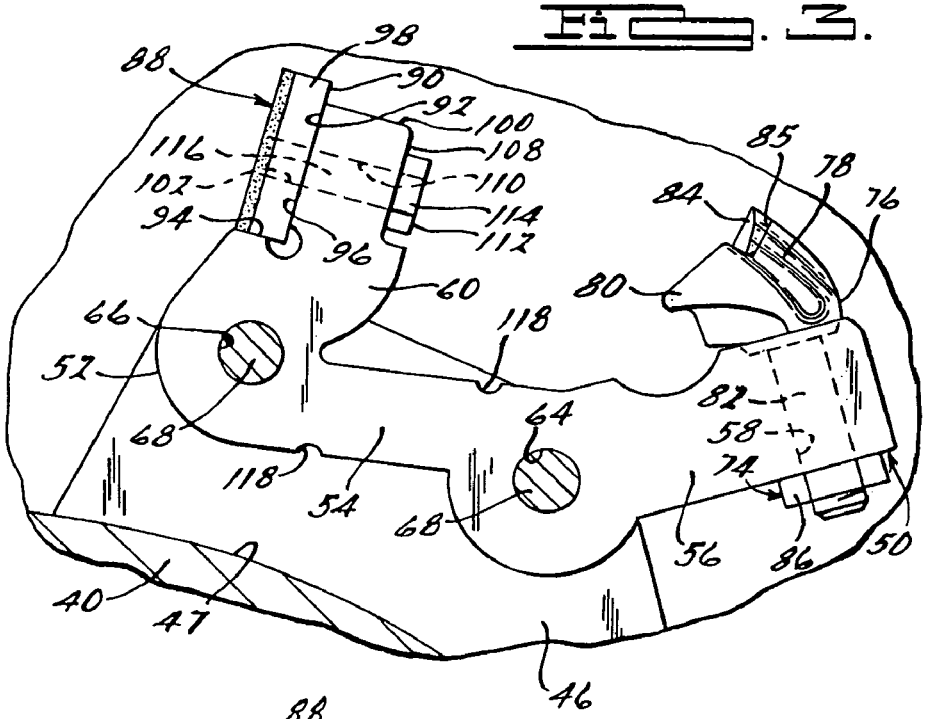
FIG. 3 is an enlarged fragmentary elevational view of a processing tool, according to the present invention, of the rotor assembly in circle 3 of FIG. 2.

Referring to FIGS. 2 and 3, the waste reducing system 14 includes a rotor assembly, according to the present invention and generally indicated at 30. The waste reducing system 14 also includes a housing 32 disposed about the rotor assembly 30 and a plurality of regrind augers 34 positioned at a bottom of the housing 32. The waste reducing system 14 further includes a movable concave screen 36 and a fixed concave screen 38 at a rear of the housing 32. It should be appreciated that the waste reducing system 14 reduces waste material by the rotor assembly 30, which passes through the screens 36, 38 to the discharge system 16. It should also be appreciated that the regrind augers 34 move reduced waste product into contact with the rotor assembly 30 for further reduction to pass through the screens 36, 38.

The rotor assembly 30 also includes a rotatable rotor 40 disposed within the housing 32 above the regrind augers 34. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface 45 of the rotor 40 by suitable means such as welding. It should be appreciated that a power source (not shown) is connected to the shaft 42 in a well-known manner and is adapted to turn the shaft 42 and rotor 40.

Figure 4:
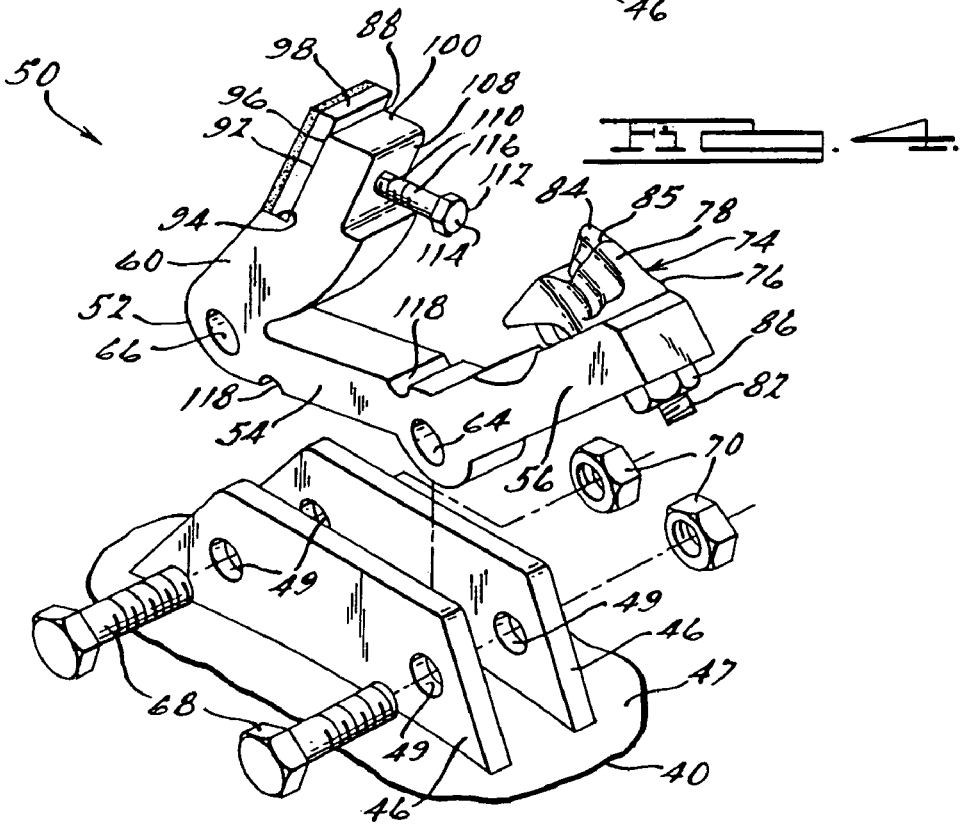
FIG. 4 is an exploded perspective view of the processing tool of FIG. 3.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral and a second spiral spaced or offset from the first spiral. The rotor assembly 30 further includes a plurality of processing tools, according to the present invention and generally indicated at 50, mounted to the mounting arms 46. The first spiral and the second spiral of mounting arms 46 extend about the rotor 40 so that in one rotation of the rotor assembly 30, every point on an imaginary axial line segment positioned adjacent to the rotor assembly 30 will be contacted by the processing tools 50 mounted to the rotor assembly 30.

Each of the processing tools 50, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54. The tool holder 52 includes an aperture 64 and 66 at a lower radial end of the first arm 56 and second arm 60, respectively, and extending axially therethrough. The body 54 has a width or thickness less than the first arm 56 and the second arm 60. The tool holder 52 is continuous, integral, unitary, and made as one-piece. It should be appreciated that the apertures 64, 66 of the tool holder 52 are aligned with the apertures 49 of the mounting arms 46.

The rotor assembly 30 includes at least one, preferably a pair of fasteners such as bolts 68 and nuts 70 for retaining the processing tools 50 to the mounting arms 46. The bolts 68 extend through the apertures 49 in the mounting arms 46 and the apertures 64, 66 of the tool holder 52 and threadably engage the nuts 70. It should be appreciated that the tool holder 52 is disposed between the mounting arms 46.

Referring to FIGS. 2 through 6, the processing tool 50 also includes a multi-functional tool assembly, generally indicated at 74 and according to the present invention, attached to the tool holder 52. The multi-functional tool assembly 74 includes a multi-functional tool 76 to aggressively intake the waste material, reduce the waste material, and aggressively output the reduced waste material by pushing the reduced waste material to the screens 36, 38 and out of the rotor assembly 30.

The multi-functional tool 76 includes a head 78, fan 80, and shaft 82. The head 78, fan 80, and shaft 82 are made of a metal material and are made as a single forging. The head 78, fan 80, and shaft 82 are a monolithic structure being integral, unitary, and one-piece.

The multi-functional tool assembly 74 includes a waste reducer 84. The waste reducer 76 is a cutter to cut or reduce the waste material. The waste reducer 84 is attached to the head 78 and disposed adjacent the fan 80. The head 78 may have a recess 85 to receive a portion of the waste reducer 84 such as in U.S. Pat. No. 6,059,210, previously described. The waste reducer 84 is attached to the head 78 by suitable means such as brazing. The waste reducer 76 is made of a carbide material and is generally rectangular or pentagonal in shape. It should be appreciated, that in another embodiment, the waste reducer 84 may be a splitter (not shown) attached to the head 78 such as in U.S. Pat. No. 6,059,210, previously described.

Referring to FIGS. 3 through 6, the fan 80 is disposed radially below the waste reducer 84. The fan 80 is generally rectangular in shape. The fan 80 has a width greater than the height thereof. Preferably, the fan 84 is disposed radially one half inch back or inward from an outer periphery of the waste reducer 84 to provide one inch of clearance between the fan 80 and an inner surface of the housing 32 of the rotor assembly 30.

The shaft 82 is disposed opposite the fan 80 and extending outwardly therefrom. The shaft 82 extends axially through the aperture 58 in the first arm 56 and is removably secured to the first arm 56 by a suitable mechanism such as a nut 86 threadably engaging the shaft 82. It should be appreciated that the fan 80 is not a cutting tooth and does not reduce the waste material, but aggressively outputs the reduced waste material. It should also be appreciated that the waste reducers 76 are typically one inch apart axially and the fan 80 is typically two inches wide axially to cover a space between the waste reducers 76. It should further be appreciated that the fan 80 may have any suitable shape or area to push reduced waste material for aggressive output thereof.

Referring to FIGS. 2 through 4, the processing tool 50 also has a replaceable raker assembly, generally indicated at 88, removably attached to the second arm 60. The replaceable raker assembly 88 includes a raker 90 disposed in a recess 92 on a forward side of a free end of the second arm 60. The recess 92 is generally rectangular in shape and has a lower surface 94 and a side surface 96. The raker 90 includes a raker wear bar 98 disposed in the recess 92. The raker wear bar 98 is generally rectangular in shape. The raker wear bar 98 is of such a length to extend outwardly beyond a radial end surface 100 of the second arm 60 when disposed in the recess 92. The raker wear bar 98 rests against and is supported by the lower surface 94 and side surface 96. The raker wear bar 98 has an aperture 102 extending axially therein for a function to be described. The raker wear bar 98 is made of a metal material such as a one-piece hard faced material such as Trimay.

The replaceable raker assembly 88 also includes another recess 108 on a rear side of a free end of the second arm 60 opposite the recess 92. The recess 108 is generally rectangular in shape. The replaceable raker assembly 88 includes an aperture 110 extending from the recess 108 to the recess 92 in the second arm 60. The replaceable raker assembly 88 further includes a fastener such as a bolt 112 to removably secure the raker wear bar 98 to the second arm 60. The bolt 120 has a head 114 disposed in the recess 108 and a threaded shaft 116 extending axially from the head 114 and through the aperture 110 in the second arm 60 and threadably engaging the threads of the aperture 102 in the raker wear bar 98. The bolt 112 is of a sufficient length to extend through the second arm 60 and into the raker wear bar 98 in an unobstructed manner without penetrating the front face of the raker wear bar 98. It should be appreciated that the second arm 60 operates as a depth-limiting guide.

The processing tool 50 may include at least one notch 118 in the tool holder 52 to control breakage of the processing tool 50. Preferably, the processing tool 50 includes a first notch 118 in the body 54 adjacent to the first arm 56 between the first arm 56 and second arm 60 on a radial outer side thereof and a second notch 118 in the body 54 adjacent to the second arm 60 between the first arm 56 and second arm 60 on a radial inner side thereof. The notches 118 extend axially across the body 54 of the tool holder 52. The notches 118 are generally arcuate in shape and have a depth of approximately one-quarter inches (0.25 inches). The position, shape, and depth of the notches 118 are varied to control breakage of the tool holder 52 relative to either the first arm 56 or second arm 60 of the tool holder 52.

In operation, the processing tool 50 is rotated by the rotor 40. The multi-functional tool assembly 74 contacts waste product, such as a roofing shingle, first approximately three revolutions before the raker wear bar 98 contacts the waste product. The waste reducer 76 cuts or splits the waste product to reduce the waste product and the fan 80 pushes the reduced waste material toward the screens 36, 38 of the rotor assembly 30. If the waste product is stuck or lodged by the multi-functional tool assembly 74 in the waste processing machine 10, the first arm 56 will concentrate stress on the tool holder 52 in the notch 118 adjacent to the first arm 56 and cause a breakage by propagating a crack from the notch 118 radially across the body 54 of the tool holder 52. As such, the first arm 56 will then pivot about the bolt 68, which acts as a first pivot pin and remains attached to the mounting arms 46 to prevent damage to the rotor assembly 30. In addition, the remainder of the tool holder 52 including the body 54 and second arm 60 will pivot about the other bolt 68, which acts as a second pivot pin and remains attached to the mounting arms 46 to prevent damage to the rotor assembly 30. The tool holder 52 can then be replaced. It should be appreciated that the multi-functional tool assembly 74 aggressively intakes the waste material, reduces the waste material, and aggressively outputs the reduced waste material from the rotor assembly 30.

During operation, if the waste reducer 84 becomes worn due to contact with the waste material, the waste reducer 84 may be removed by unsoldering or unbrazing the waste reducer 84 from the head 78 of the multi-functional tool 76. The worn waste reducer 84 can be discarded and replaced with a new waste reducer 84. The waste reducer 84 is disposed in the recess 85 and soldered or brazed to the head 78 of the multi-functional tool 76 to secure the waste reducer 84 in place.

During operation, if the raker wear bar 98 becomes worn due to contact with the waste material, the bolt 112 may be removed by unthreading the threaded shaft 116 from the raker wear bar 98. The worn raker wear bar 98 can be discarded and replaced with a new raker wear bar 98. The bolt 112 is then threaded with the threads of the aperture 102 to secure the raker wear bar 98 in place.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A multi-functional tool assembly for a waste processing machine comprising:

a waste reducer adapted to reduce waste material within the waste processing machine; and a single tool to support said waste reducer, said tool including a head, a fan, and a shaft integrally formed therein, said fan being disposed radially below said waste reducer to aggressively output reduced waste material from the waste processing machine.

2. A multi-functional tool assembly as set forth in claim 1 wherein said head, said fan, and said shaft is made of a metal material.

3. A multi-functional tool assembly as set forth in claim 1 wherein said head, said fan, and said shaft is made as a single forging.

4. A multi-functional tool assembly as set forth in claim 1 wherein said head, said fan, and said shaft is made a monolithic structure being unitary and one-piece.

5. A multi-functional tool assembly as set forth in claim 1 wherein said fan has an axial width greater than said waste reducer.

6. A multi-functional tool assembly as set forth in claim 1 wherein said waste reducer is a cutter made of a carbide material for cutting waste material.

7. A multi-functional tool assembly as set in claim 1 wherein said fan has a generally rectangular shape.

8. A processing tool for a waste processing machine comprising:

a tool holder for attachment to a rotor assembly of the waste processing machine; and a single multi-functional tool assembly attached to said tool holder to reduce waste material comprising a waste reducer to reduce waste material and a single tool to support said waste reducer, said tool including a head, a fan, and a shaft integrally formed therein, said fan being disposed radially below said waste reducer to aggressively output the reduced waste material from the rotor assembly of the waste processing machine.

9. A processing tool as set forth in claim 8 wherein said tool holder comprises a first arm extending radially and a second arm extending radially and spaced from said first arm.

10. A processing tool as set forth in claim 9 wherein said multi-functional tool assembly is attached to said first arm.

11. A processing tool as set forth in claim 9 including a raker attached to said second arm.

12. A processing tool as set forth in claim 8 wherein said head, said fan, and said shaft is made of a metal material.

13. A processing tool as set forth in claim 8 wherein said head, said fan, and said shaft is made as a single forging.

14. A processing tool as set forth in claim 8 wherein said head, said fan, and said shaft is made a monolithic structure being unitary and one-piece.

15. A processing tool as set in claim 8 wherein said fan has a width greater than said waste reducer.

16. A processing tool as set forth in claim 8 wherein said waste reducer is a cutter made of a carbide material for cutting waste material.

17. A processing tool as set in claim 8 wherein said fan has a generally rectangular shape.

18. A waste processing machine comprising:

a rotor assembly;

at least one tool holder attached to said rotor assembly, wherein said at least one tool holder includes a first arm extending radially and a second arm extending radially and spaced from said first arm; and a single multi-functional tool assembly comprising a cutter to reduce waste material and a single tool to support said cutter, said tool including a head, a fan, and a shaft integrally formed therein, said fan disposed radially below said cutter to aggressively output the reduced waste material from said rotor assembly and shaft being disposed opposite said fan and extending outwardly away therefrom and attached to either one of said first arm and said second arm of said tool holder.

* * * * *